US006903257B2

(12) United States Patent
Yun

(10) Patent No.: US 6,903,257 B2
(45) Date of Patent: Jun. 7, 2005

(54) BASS DRUM PEDAL WITH ECCENTRICITY-ADJUSTABLE CAM SYSTEM

(76) Inventor: Sang Jae Yun, 314-102 Songgang Green Apt, Songgang-dong, Yusung-gu, Daejeon (KR)

( * ) Notice: Subject to any disclaimer, the term of this patent is extended or adjusted under 35 U.S.C. 154(b) by 85 days.

(21) Appl. No.: 10/666,761

(22) Filed: Sep. 22, 2003

(65) Prior Publication Data

US 2004/0060421 A1 Apr. 1, 2004

(30) Foreign Application Priority Data

Oct. 1, 2002 (KR) ..... 10-2002-0059724

(51) Int. Cl.[7] ..... G10D 13/02
(52) U.S. Cl. ..... 84/422.1; 84/422.2
(58) Field of Search ..... 84/422.1, 422.2

(56) References Cited

U.S. PATENT DOCUMENTS 5,540,131 A * 7/1996 Shigenaga ..... 84/422.1
5,714,701 A * 2/1998 Hsieh ..... 84/422.1
6,172,291 B1 1/2001 Takegawa ..... 84/422.1
6,222,108 B1 * 4/2001 Liao ..... 84/422.1

* cited by examiner

*Primary Examiner*—Shih-Yung Hsieh
(74) *Attorney, Agent, or Firm*—Park & Sutton LLP; John K. Park

(57) ABSTRACT

An enhanced bass drum pedal is provided with an eccentricity-adjustable cam system comprising a cam core mounted on a rotating shaft, a cam member rotatably connected to the cam core by a first pin, a positioning member rotatably connected to the cam member by a second pin, and a set screw. The positioning member is fastened onto the cam core by the set screw at a selected position of the positioning member to adjust the eccentricity of the cam system relative to the axis of rotation. As a result, a user can readily alter the impact force acted on a drum head and the restoring force applied to the foot board thereby tuning the bass drum pedal to suit the user's playing style and ability.

4 Claims, 6 Drawing Sheets

BASS DRUM PEDAL WITH ECCENTRICITY-ADJUSTABLE CAM SYSTEM

CLAIMING FOREIGN PRIORITY

The applicant claims and requests a foreign priority, through the Paris Convention for the Protection of Industry Property, based on a patent application filed in the Republic of Korea (South Korea) with the filing date of Oct. 1, 2002, with the patent application number 10-2002-0059724, by the applicant. (see the attached declaration)

BACKGROUND OF THE INVENTION

1. Field of the Invention

This invention relates generally to improvements in a foot-operated bass drum pedal and more particularly to a bass drum pedal with a cam system wherein a user may adjust the eccentricity of the cam system to thereby obtain an optimized drum pedal for a user's performance.

2. Description of Related Art

A drummer plays the bass drum by pressing down the drum pedal. Each drummer needs his own drum pedal suitable to him because each drummer has different playing style and physical condition.

The primary factors that determine the overall feels of the drum pedal to the drummer himself and the performance characteristics are an impact force and a restoring force. In this description, the impact force is defined as a force acted on a bass drum head by a beater when the beater strikes the drum head, and the restoring force is defined as a force applied to a foot board by a spring to return the foot board to its original up-position.

A strong impact force enables the drummer to play a powerful performance, and a strong restoring force enables the drummer to play a speedy performance.

With the same stepping force on the foot board, the impact force acted on the drum head by the beater and the restoring force applied to the foot board by the spring depend on the torque arm of the cam system.

When the torque arm of the cam system is long, the impact force acted on the drum head by the beater is strong. But in this case, the restoring force applied to the foot board by the spring thereby returning the foot board to its original up-position is weak. On the contrary, when the torque arm is short, the impact force is weak and the restoring force is strong.

Because the impact force and the restoring force suitable to each drummer might vary, conventional drum pedal companies have provided many kinds of drum pedals, each of which has different torque arm of cam system, thereby permitting the drummers to selectively purchase the suitable one to him. But when a drummer's playing style changes, a drummer must buy a new pedal. And if a drummer intends to try a variety of playing styles, he has to purchase a plurality of drum pedals with different cam features.

Therefore, there's been a need for a drum pedal wherein the torque arm of the cam system is adjustable. A prior art that meets the above need is U.S. Pat. No. 6,172,291.

Said prior art provides a plurality of interchangeable cam members with different shape and radius for selective attachment to the drum pedal sprocket. But it takes a great deal of time to remove a cam member and interchange it with another one, and it is liable to lose the cam members not in use.

The present invention tends to solve the above problems and permits the user to tune the bass drum pedal up more efficiently and precisely to suit the user's style and ability without any risk of missing cam members.

SUMMARY OF THE INVENTION

Torque arm of the cam system is the distance from the axis of rotation defined by the rotating shaft to the outer surface of the cam system, and depends on the eccentricity of the cam system. Therefore if the eccentricity of the cam system changes, so does the torque arm.

As a result, the impact force and the restoring force depend on the eccentricity of the cam system because the torque arm depends on the eccentricity of the cam system.

The present invention provides an enhanced bass drum pedal with an eccentricity-adjustable cam system wherein a user may easily adjust the eccentricity of the cam system thereby easily changing the impact force and the restoring force to suit his playing style and ability without interchanging cam members.

And with a single cam system of this invention the user can readily alter the performance characteristics, playing response and overall feels of the pedal to the user, so the user need not carry a plurality of cam members.

The present invention is embodied in a foot-operated bass drum pedal that includes a horizontally extending base plate, two upright posts mounted on and attached to the base plate, a rotating shaft rotatably supported by the two posts, a foot board hingedly connected to the base plate, an eccentricity-adjustable cam system mounted on the rotating shaft, a flexible drive linkage drvingly connecting the foot board with the cam system, a beater driven by the rotating shaft to strike a drum head, a crank carried by the rotating shaft, and a spring connected between the crank and the lower end of the post.

The flexible drive linkage, which partially overlies the outer surface of the cam system, has two opposite end portions, one of which is anchored to the front portion of the foot board and the other of which is anchored to the eccentricity-adjustable cam system.

The eccentricity-adjustable cam system of this invention comprises a cam core mounted on and attached to the rotating shaft, a cam member rotatably connected to the cam core by a first pin, a positioning member rotatably connected to the cam member by a second pin, and a set screw fastening the positioning member onto the cam core.

The positioning member is adjustably positioned onto the cam core by the set screw to thereby adjust the eccentricity of the cam system and accordingly torque arm. As a result, the impact force acted on a drum head and the restoring force applied to the footboard may be readily altered according to the user's intention. And a user may have a drum pedal suitable to his playing style and ability by adjusting the eccentricity-adjustable cam system.

These and other objects and advantages of the invention, as well as the details of the illustrative embodiments will be more fully understood from the following specification and drawings.

DETAILED DESCRIPTION OF THE PREFERRED EMBODIMENTS

Figure 1:
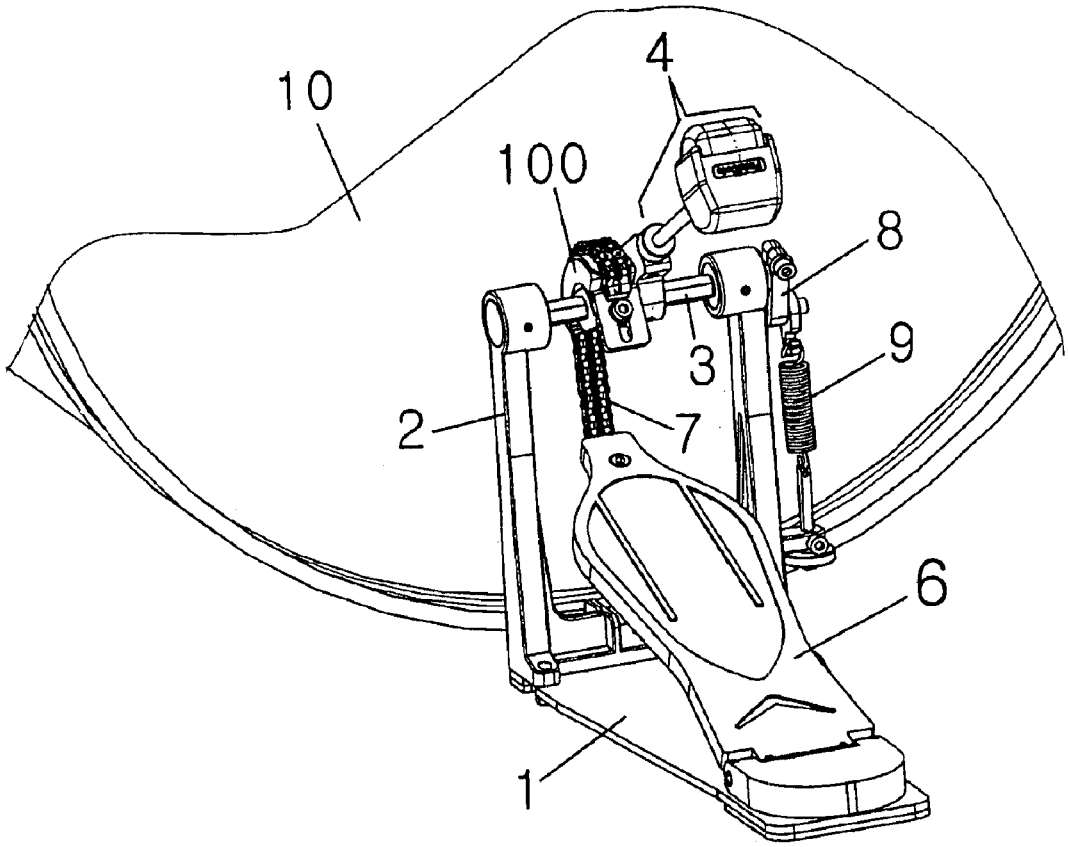
FIG. 1 is a perspective view of bass drum pedal.

As shown in FIG. 1, basically a bass drum pedal of this invention includes an elongated horizontal base plate 1, two upright laterally spaced posts 2 mounted on and attached to the base plate, and a shaft 3 rotatably supported by the two posts via bearings located in the upper portions of the two posts.

The base plate supports all the other members of the drum pedal. Instead of the base plate, a suitable wire structure adapted to support the posts, foot board, and so on may be provided.

The shaft 3 extends between the two posts 2 and may be polygonal to mount a cam system.

The eccentricity-adjustable cam system 100 is mounted on the shaft 3 and may have a corresponding polygonal bore 112 to closely fit the shaft 3.

The shaft 3 carries a beater 4, which is mounted on the shaft 3 in driven relation to strike a drum head.

The eccentricity-adjustable cam system 100 engages a flexible drive linkage 7 driven by the foot board 6. The flexible drive linkage 7, which partially overlies the outer surface of the cam system 100, has two opposite end portions, one of which is anchored to the front portion of the foot board 6 and the other of which is anchored to the eccentricity-adjustable cam system 100.

Although the drawings show a chain as the flexible drive linkage 7, the flexible drive linkage 7 may be a chain or a strap.

An elongated foot board 6 extends in inclined relation above the base plate 1. The rear portion of the foot board 6 is hingedly connected to the base plate 1, and the front portion of the foot board is attached to the flexible drive linkage 7.

A crank 8 is carried by the shaft 3. A spring is connected between the crank 8 and the lower end of the post 2 to return the beater and the foot board to their original position for the next striking.

Figure 2A:
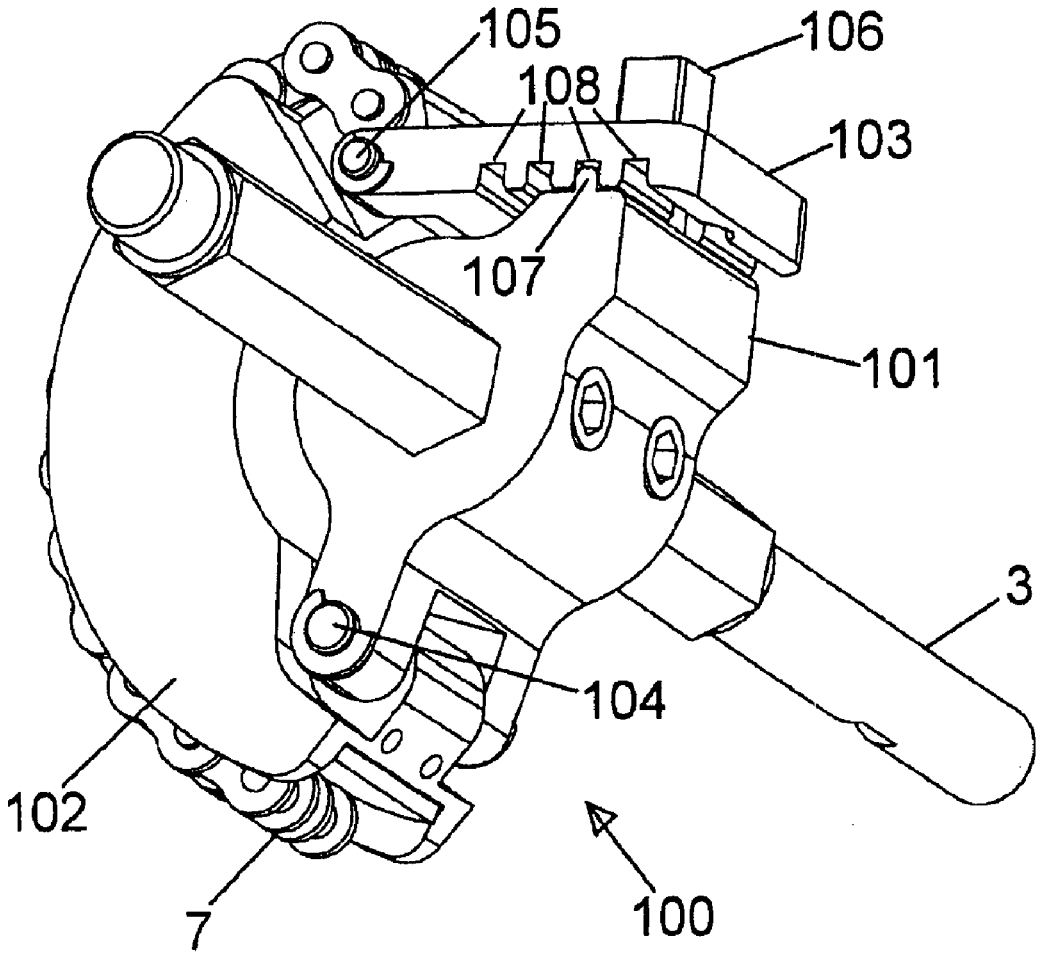
FIG. 2A is a perspective view of eccentricity-adjustable cam system of this invention.

The eccentricity-adjustable cam system 100 of this invention will be described more specifically with reference to FIG. 2, FIG. 3 and FIG. 4.

The eccentricity-adjustable cam system 100 of this invention comprises a cam core 101 mounted on and attached to the shaft 3, a cam member 102 rotatably connected to the cam core 101, a positioning member 103 rotatably connected to the cam member 102, a first pin 104 rotatably connecting the cam member 102 with the cam core 101, a second pin 105 rotatably connecting the positioning member 103 with the cam member 102, and a set scew 106 fastening the positioning member 103 onto the cam core 101.

The set scew 106 fastens the positioning member 103 onto the cam core 101 to adjustably position the positioning member 103 onto the cam core 101, while the cam core 101 remains affixed to the rotating shaft 3, thereby defining the eccentricity of the cam system 100.

With reference to FIG. 2A through FIG. 4B the eccentricity-adjustable cam system 100 of this invention will now be described in detail.

Figure 2B:
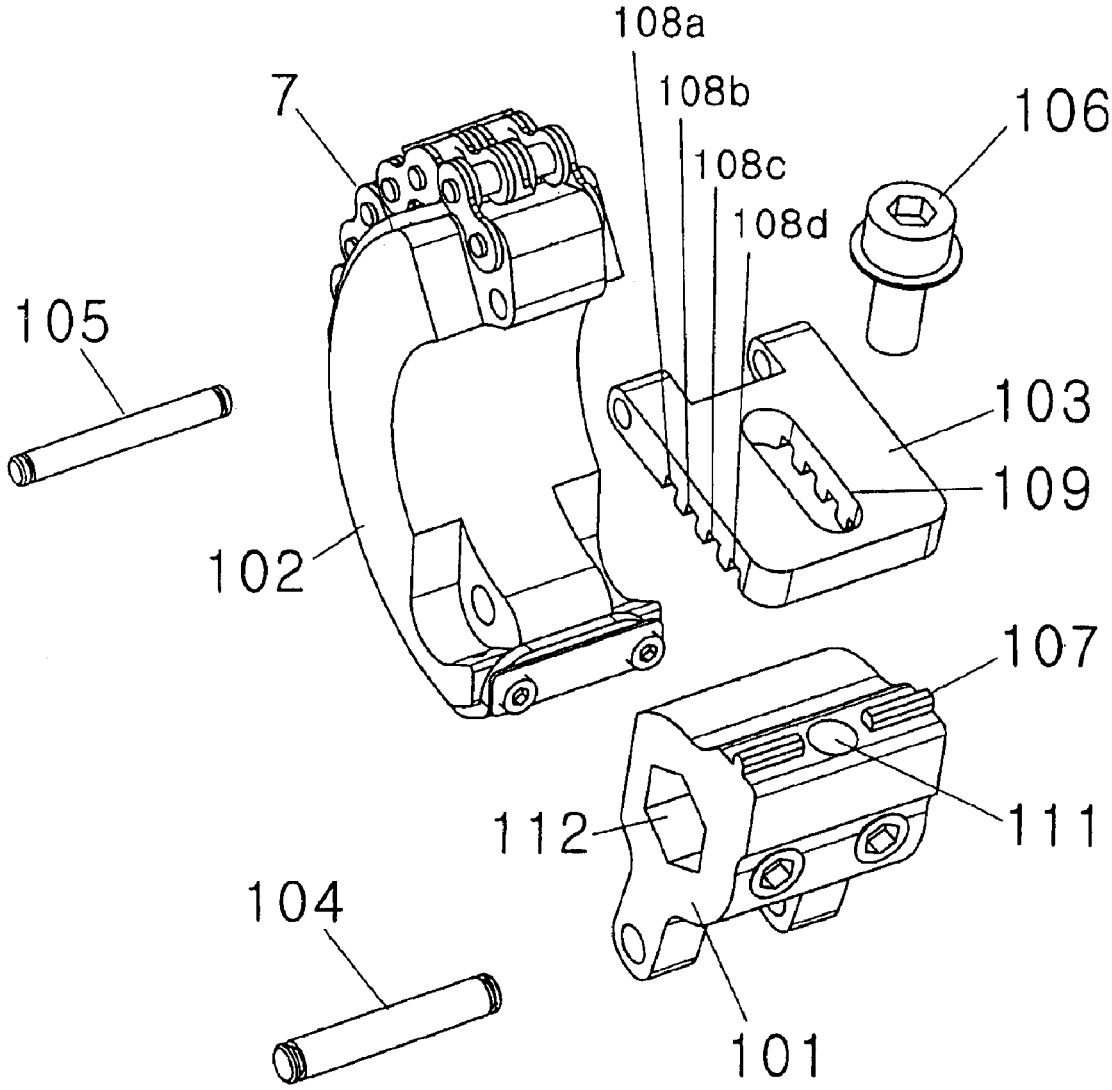
FIG. 2B is an exploded view of eccentricity-adjustable cam system of this invention.

As shown in FIG. 2B, a preferred embodiment of this invention provides a slot 109 passing through the positioning member 103 and four grooves 108*a*, 108*b*, 108*c*, and 108*d* in the positioning member 103.

The width of the slot 109 is wider than outer diameter of the set screw 106 and narrower than the diameter of the set screw head. The length of the slot defines the range wherein the eccentricity of the cam system 100 may vary. The four grooves are located spaced and the mid-portions of the grooves are cut by the slot 109. The cam core 101 includes a female thread 111 for engaging the set screw 106, and a protrusion 107 for engaging one of the four grooves in the positioning member 103.

The eccentricity of the eccentricity-adjustable cam system 100 depends on which groove of the positioning member 103 engages the protrusion 107 on the cam core 101.

Figure 3A:
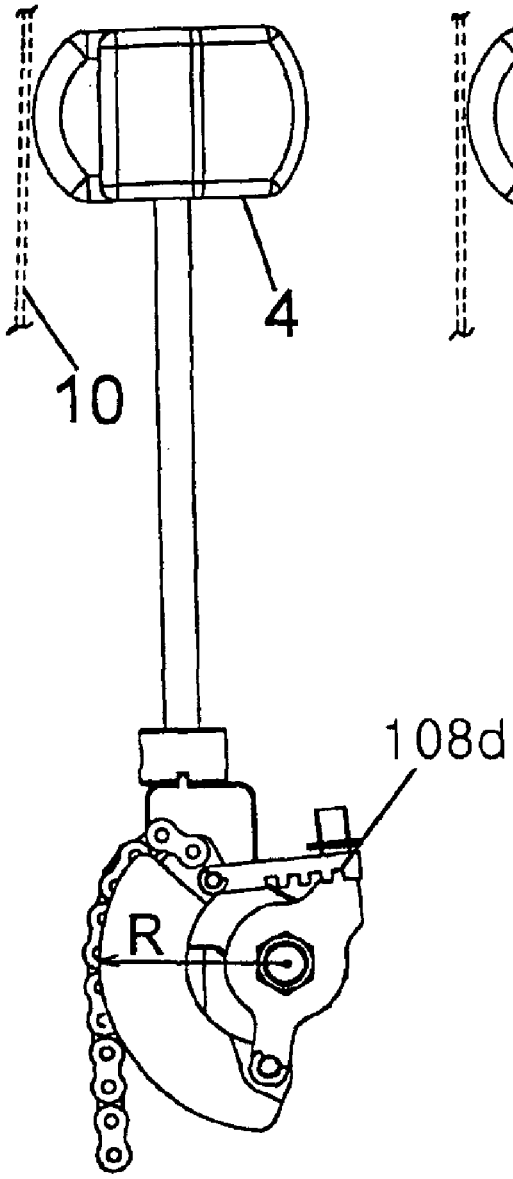
FIG. 3A is a side view of the eccentricity-adjustable cam system and beater of this invention as the beater strikes a drum head with the torque arm being maximum.
Figure 3B:
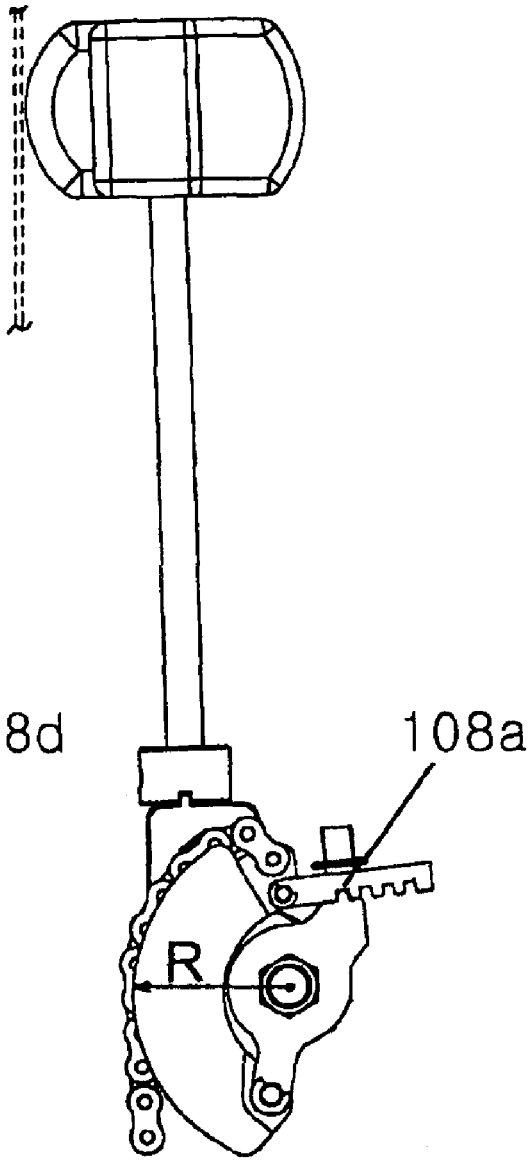
FIG. 3B is a side view of the eccentricity-adjustable cam system and beater of this invention as the beater strikes a drum head with the torque arm being minimum.

Two representatives wherein the eccentricity of the cam system is adjusted are shown in FIG. 3A and FIG. 3B. In FIG. 3A the cam system is adjusted to have the longest torque arm R, and in FIG. 3B the cam system is adjusted to have the shortest torque arm R.

In FIG. 3A the fourth groove 108*d* of the positioning member 103 matingly engages the protrusion 107 of the cam core 101, and as a result, the torque arm is maximum. In FIG. 3B the first groove 108*a* of the positioning member 103 matingly engages the protrusion 107 of the cam core 101, and as a result, the torque arm is minimum.

The torque arm between maximum and minimum can be obtained by utilizing second or third groove. By adjusting the torque arm as described above, the impact force and the restoring force can be altered.

Although this preferred embodiment provides the drum pedal with four-grade-tuning system, this invention should not limited to any particular number of grooves in the positioning member 103. The positioning member 103 may have two, three or a plurality of grooves more than four.

Figure 4A:
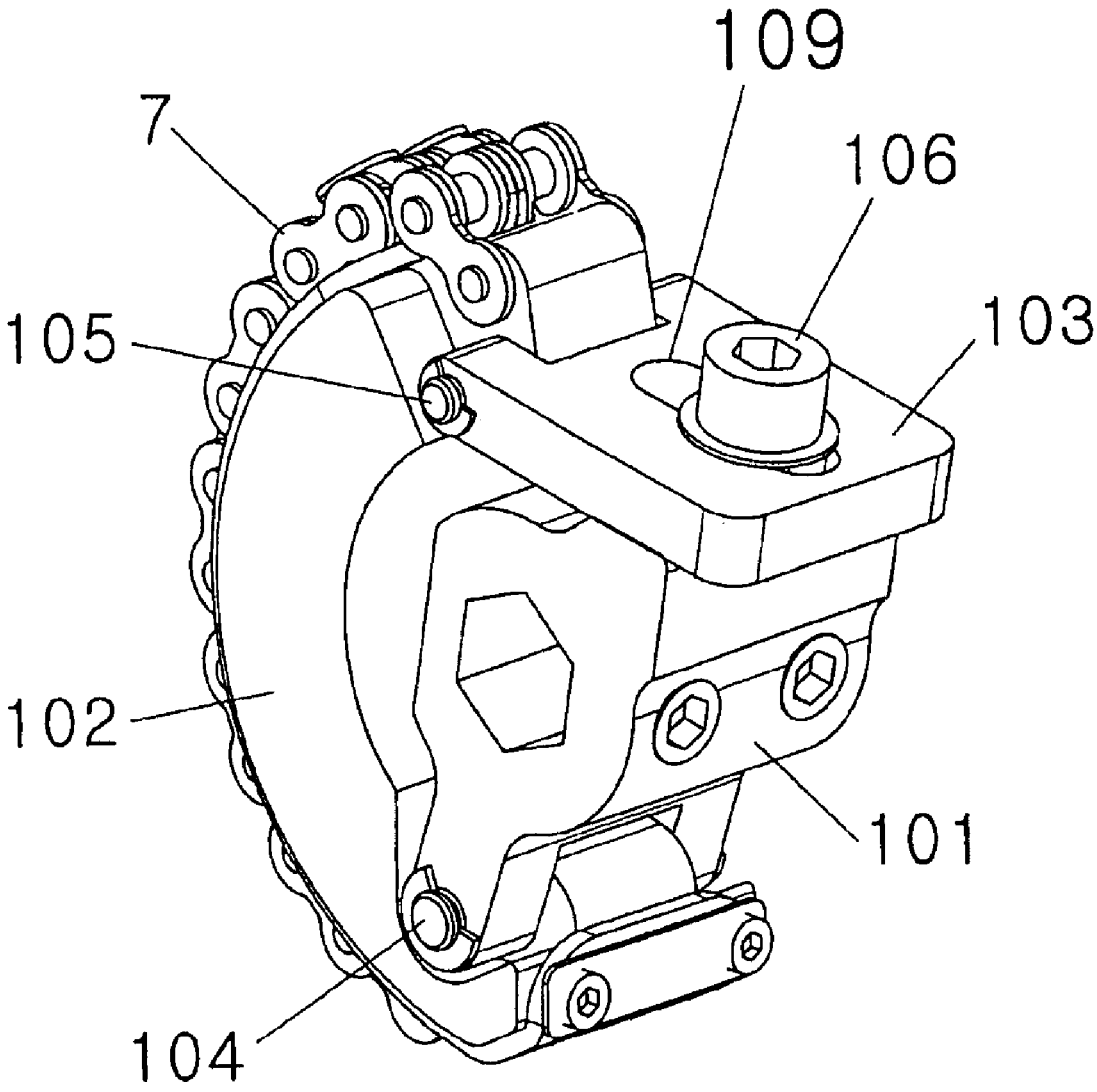
FIG. 4A is a perspective view of another embodiment of this invention.
Figure 4B:
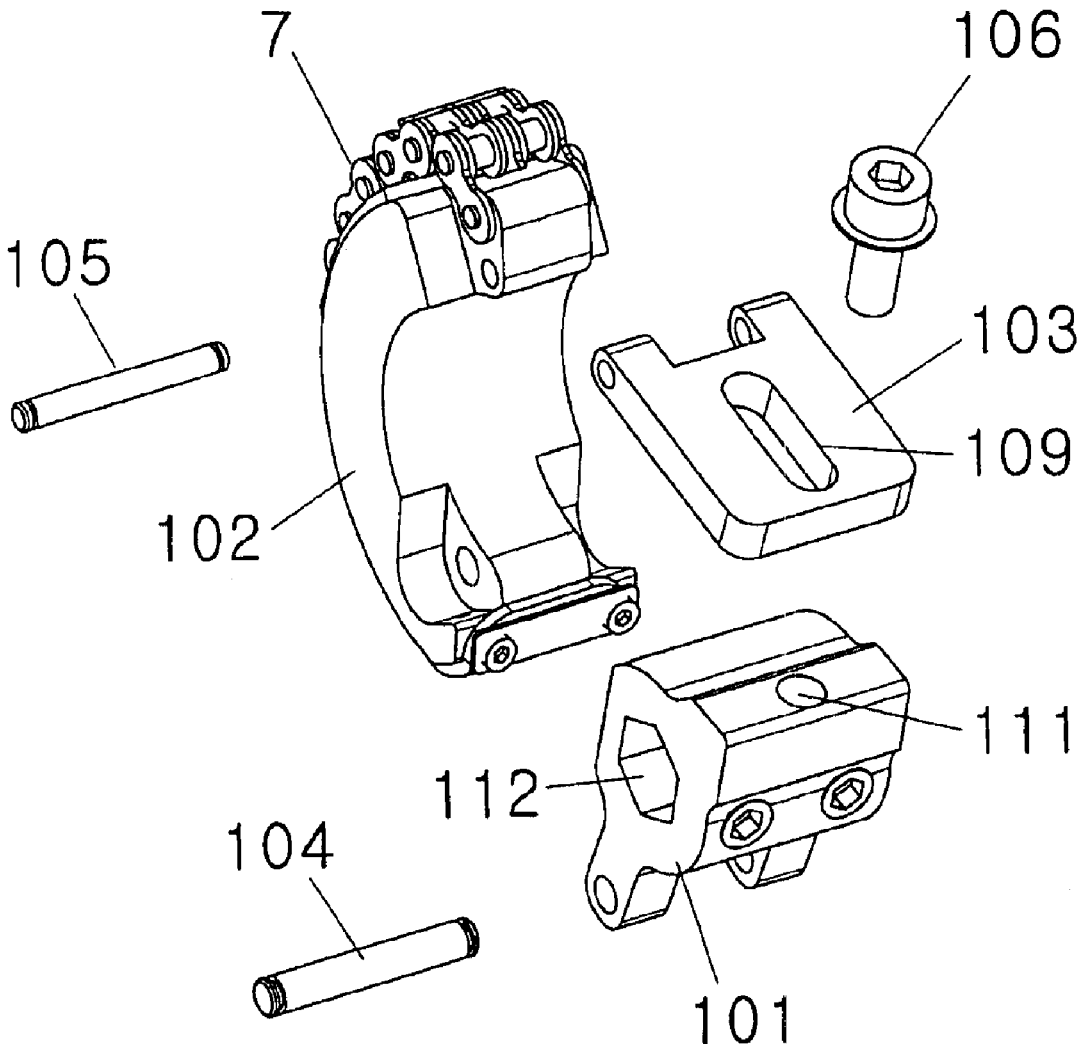
FIG. 4B is an exploded view of another embodiment of this invention.

Another embodiment of this invention will be described with reference to FIGS. 4A and 4B.

The cam core 101 is provided with no protrusion and the positioning member 103 is provided with no groove. As shown in FIG. 4B, the positioning member has a slot 109 passing through the positioning member 103 and the cam core has a corresponding female thread 111 for the set screw 106. The width of the slot 109 is wider than outer diameter of the set screw 106 and narrower than the diameter of the set screw head. The length of the slot 109 defines the range wherein the eccentricity of the cam system may vary. The eccentricity of the cam system depends on which portion of the slot 109 the positioning member 103 is fastened onto the cam core 101 at.

This embodiment provides more various and exquisite adjustment for the eccentricity of the cam system.

The operation of the bass drum pedal of the present invention will be illustrated in detail hereinafter with reference to drawings.

As easily understood from FIG. 1, when the drummer steps on the foot board 6, the front end of the foot board is depressed and accordingly the flexible drive linkage 7 connected to the front end of the foot board is displaced downward thereby rotating the eccentricity-adjustable cam system 100.

The rotation of the cam system 100 causes the rotating shaft 3 to rotate thereby driving the beater 4 to strike the drum head 10.

The rotation of the rotating shaft 3 also causes the crank 8 to rotate thereby elongating the spring 9, and accordingly the restoring force is applied to the foot board 6 for returning the foot board to the original up-position.

When the drummer stops depressing the foot board 6, the foot board returns to its original up-position by the spring 9 for the next striking.

With the same stepping force on the foot board 6, the impact force acted on the drum head 10 by the beater 4 and the restoring force applied to the foot board 6 by the spring 9 depends on the torque arm.

The user may adjust easily the bass drum pedal of this invention wherein the eccentricity of the cam system is adjustable thereby varying the impact force and the restoring force to suit the user's playing style.

Therefore the user need not purchase a new drum pedal but may just tune up the pedal of this invention by adjusting the eccentricity of the cam system to suit his changed playing style.

And with a single cam system of this invention the user can readily alter the performance characteristics, playing response and overall feels of the drum pedal to the user, so the user need not carry a plurality of cam members.

While the foregoing invention has been illustrated and described with reference to a number of preferred embodiments, it will be understood by those having skill in the art that various changes in form and detail may be made therein without departing from the spirit and scope of this invention.

What is claimed is:

1. A bass drum pedal comprising:

a base plate;

two laterally spaced upright posts mounted on and attached to said base plate;

a rotating shaft rotatably supported by said two posts at the upper portions of said two posts;

an eccentricity-adjustable cam system comprising a cam core mounted on said rotating shaft, a cam member rotatably connected to said cam core, a first pin rotatably connecting said cam member with said cam core, a positioning member rotatably connected to said cam member, a second pin rotatably connecting said positioning member with said cam member, and a set screw for fastening said positioning member onto said cam core;

a foot board hingedly connected to said base plate to be actuated by a user's foot;

a flexible drive linkage drvingly connecting said foot board with said eccentricity-adjustable cam system;

a beater driven by said rotating shaft to strike a drum head;

a crank carried by said rotating shaft;

and a spring connected between said crank and the lower end of one of said two posts;

wherein said positioning member comprises a slot passing therethrough, and said cam core comprises a female thread for engaging said set screw, and said set screw fastens said positioning member onto said cam core through said slot, and wherein said positioning member is adjustably positioned onto said cam core by said set screw and said female thread while said cam core remains affixed to said rotating shaft to thereby adjust the eccentricity of said eccentricity-adjustable cam system.

2. The bass drum pedal of claim 1, wherein said positioning member further comprises a plurality of grooves, and said cam core further comprises a protrusion for engaging one of said grooves.

3. An eccentricity-adjustable cam system for a foot-actuated drum pedal for beating a drum, said eccentricity-adjustable cam system comprising:

a cam core comprising a bore to hold a rotating shaft passing therethrough;

a cam member rotatably connected to said cam core;

a first pin rotatably connecting said cam member with said cam core;

a positioning member rotatably connected to said cam member;

a second pin rotatably connecting said positioning member with said cam member;

a set screw for fastening said positioning member onto said cam core;

said positioning member comprising a slot passing therethrough, and said cam core comprising a female thread for engaging said set screw, wherein said set screw fastens said positioning member onto said cam core through said slot, and wherein said positioning member is adjustably positioned onto said cam core by said set screw and said female thread while said cam core remains affixed to said rotating shaft to thereby adjust the eccentricity of said eccentricity-adjustable cam system.

4. An eccentricity-adjustable cam system of claim 3, wherein said positioning member further comprises a plurality of grooves, and said cam core further comprises a protrusion for engaging one of said grooves.

* * * * *